US005390717A

United States Patent [19]

Schenker et al.

[11] Patent Number: 5,390,717

[45] Date of Patent: Feb. 21, 1995

[54] GOLF BAG COVER

[75] Inventors: Barbara A. Schenker; Wilbur A. Raumann; Marguerite L. Raumann, all of Hobe Sound, Fla.

[73] Assignee: B.B.S., Inc., Hobe Sound, Fla.

[21] Appl. No.: 209,863

[22] Filed: Mar. 11, 1994

[51] Int. Cl.[6] ..... A65B 55/00

[52] U.S. Cl. ..... 150/159; 206/315.4

[58] Field of Search ..... 150/154, 159; 206/315.4

[56] References Cited

U.S. PATENT DOCUMENTS

| | | | |
|---|---|---|---|
| 1,899,825 | 2/1933 | Reach | 206/315.4 |
| 2,217,353 | 10/1940 | Wyman | 206/315.4 |
| 2,519,217 | 4/1952 | Thompson | 206/315.4 |
| 2,613,952 | 10/1952 | Lannon | 206/315.4 X |
| 2,718,251 | 9/1955 | Barbato | 206/315.4 X |
| 2,747,637 | 5/1956 | Brown | 150/159 |
| 2,985,212 | 5/1961 | Dozier | 150/159 |
| 3,977,451 | 8/1976 | Duba . | |
| 4,200,133 | 4/1980 | Whitlow . | |
| 4,453,632 | 6/1984 | Clower | 206/315.4 |
| 4,498,579 | 2/1985 | Brick | 206/315.4 |
| 4,512,465 | 4/1985 | Jobe | 206/315.4 |
| 4,752,004 | 6/1988 | Very | 206/315.4 |
| 4,953,697 | 9/1990 | Stanley | 206/315.4 |
| 4,953,768 | 9/1990 | Muse | 150/159 X |
| 4,979,548 | 12/1990 | Howard, III et al. | 150/159 |
| 5,005,623 | 4/1991 | Webster, Jr. | 150/159 |
| 5,024,259 | 6/1991 | Treadway | 150/159 |
| 5,058,642 | 10/1991 | Tuntland | 150/159 |
| 5,131,442 | 7/1992 | Bevier | 150/159 |
| 5,146,967 | 9/1992 | Chapman | 150/159 |
| 5,220,950 | 6/1993 | Cordasco | 150/159 |
| 5,274,901 | 1/1994 | Sanders | 150/159 X |

*Primary Examiner*—Allan N. Shoap
*Assistant Examiner*—Christopher McDonald
*Attorney, Agent, or Firm*—Quarles & Brady

[57] ABSTRACT

A flexible cover has a hood with a first opening for receiving an open end of a golf bag to protect the golf clubs retained in the golf bag. The hood has a closeable second opening through which the golf clubs can be removed from the bag and a flap on the hood can cover the second opening. An apron is attached to the hood extending downward over a lower portion of the golf bag. A separate wing flap is attached to opposite sides of the apron and to the hood. The wing flaps extend around the bag to hold the apron against the lower portion of the bag.

10 Claims, 4 Drawing Sheets

GOLF BAG COVER

BACKGROUND OF THE INVENTION

The present invention relates to covers for protecting the openings in a golf bag.

Typical golf bags have a generally cylindrical shape with one end open to receive golf clubs which protrude from that end. Many bags include a cover that attaches over the open end of the bag to shield the club and the bag opening from rain and dust. Previous covers either had to be detached from the bag in order to gain access to the clubs or the cover had an opening through which the clubs are inserted and removed from the bag with both versions shown in U.S. Pat. No. 4,998,579.

Although the covers with opening often included a mechanism, such as a zipper, for closing the opening, golfers often found the mechanism cumbersome and awkward to operate when repeatedly removing and replacing clubs from the bag. As a consequence the mechanism frequently was not used to close the opening while the golfer was using a club. In addition, many closures still allowed rain water to seep through.

Furthermore most previous covers merely fit over the open end of the bag and did not protect the lower portion of the bag which usually contained storage pockets.

SUMMARY OF THE INVENTION

A general object of the present invention is to provide a removable cover for the open end of a golf bag which cover also shields the lower portion of the bag.

This object is fulfilled by a cover that has a hood with a first opening for receiving the open end of the golf bag. A golfer is able insert and remove golf clubs through a second opening in the hood and a mechanism, such as a zipper, may be included for closing the second opening. In the preferred embodiment of the cover, a flap is attached to the hood to removably extend over the second opening, thereby preventing rain from penetrating that opening.

In the preferred embodiment, a zipper is use to close the second opening and tabs are provided at the ends of that opening for the golfer to grasp when operating the zipper. The zipper and tabs are under the flap so that during rain the golfer does not have to touch a wet portion of the cover in order to access the golf clubs.

A flexible apron is attached to the hood to protect a lower portion of the golf bag which projects from the hood. A separate wing flap is connected to each side edge of the apron and to the hood. The wing flaps extend around the bag to hold the apron against the lower portion of the bag.

DETAILED DESCRIPTION OF THE INVENTION

Figure 2:
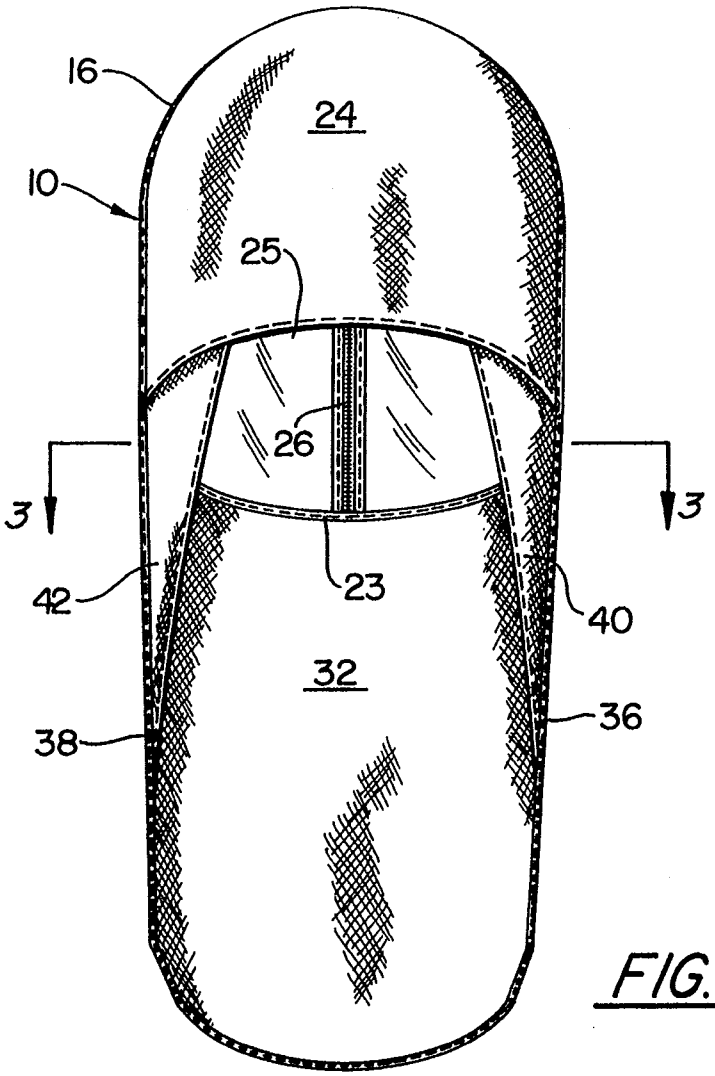
FIG. 2 is a plane view of the back of the golf bag cover.
Figure 1:
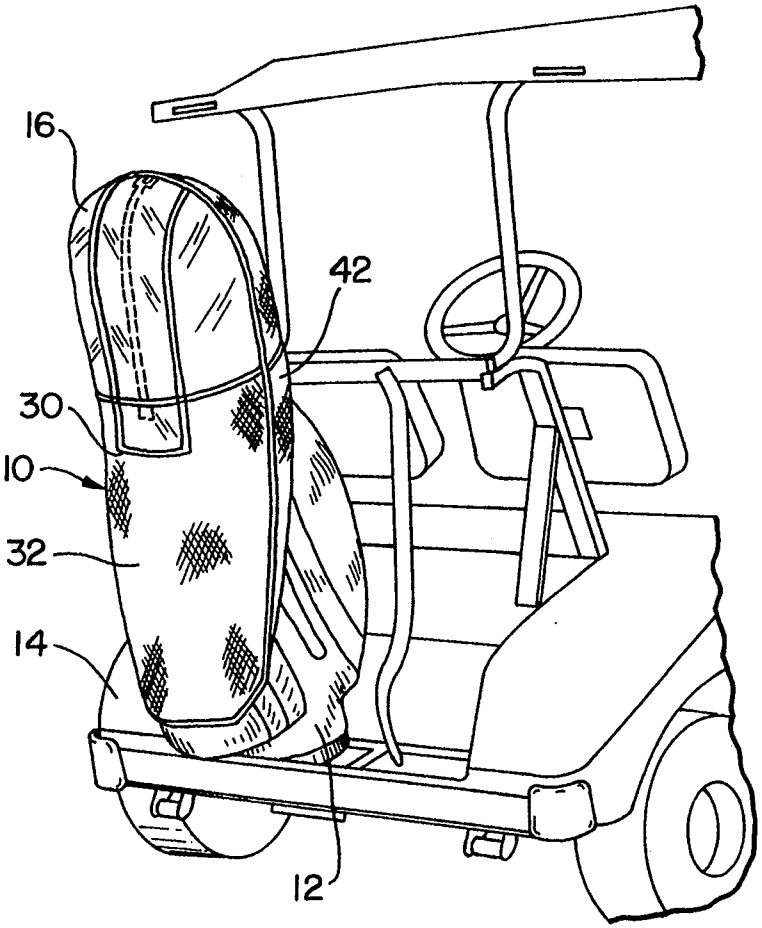
FIG. 1 is a pictorial view of a golf bag according to the present invention placed over a golf bag on a golf cart.
Figure 4:
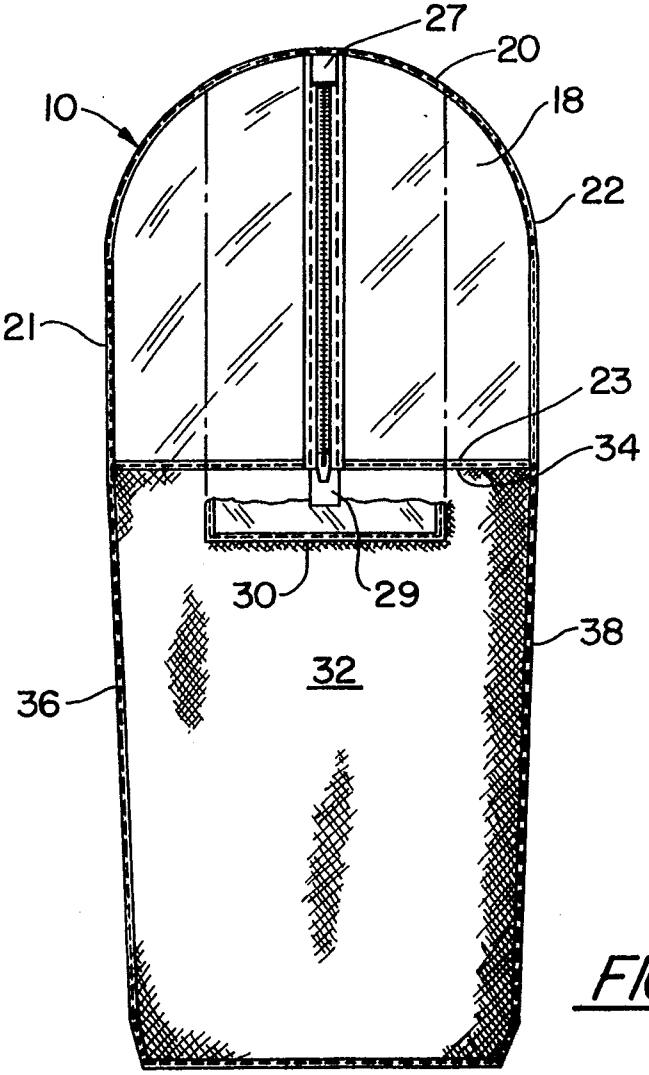
FIG. 4 is a front view of the golf bag cover.
Figure 3:
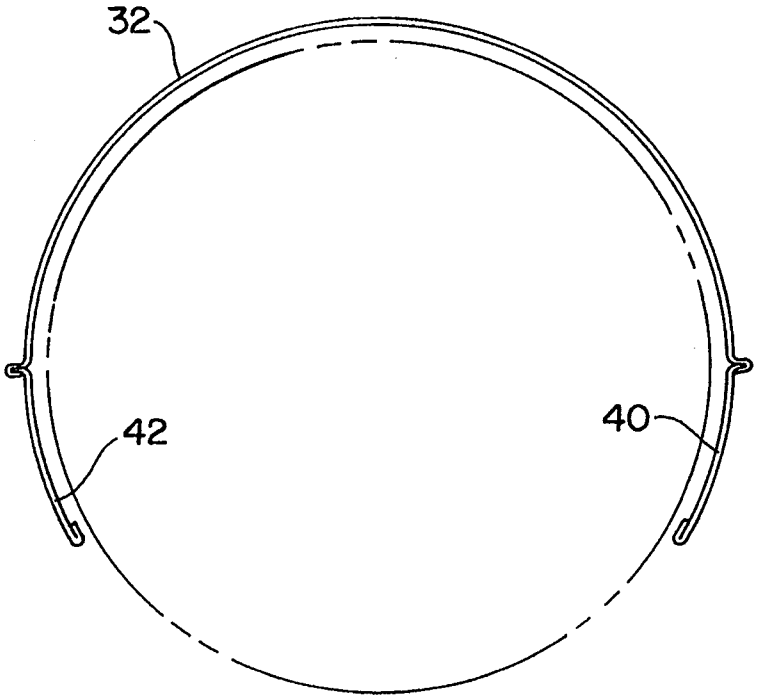
FIG. 3 is a cross section view taken along line 3—3 of FIG. 2.
Figure 5:
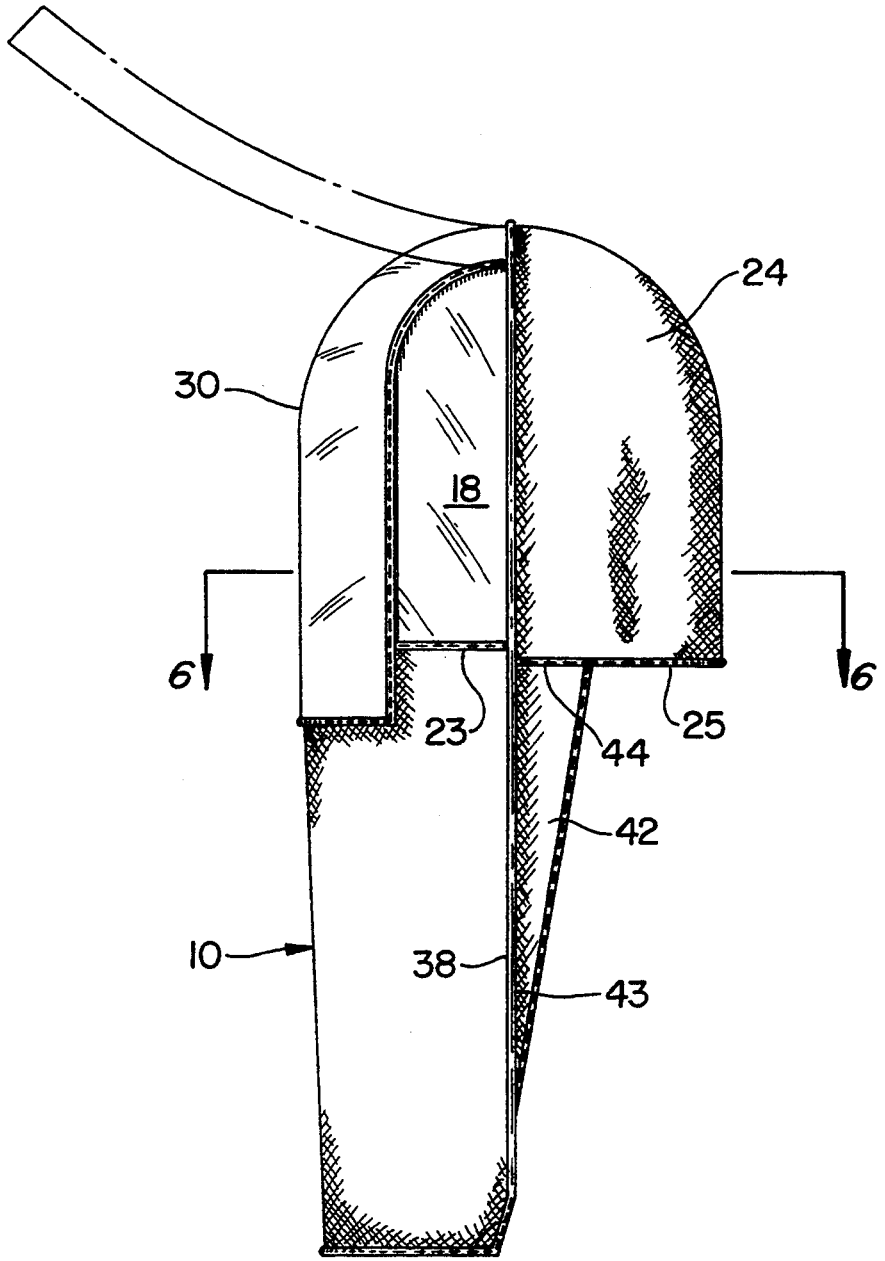
FIG. 5 is a plane view of a side of the golf bag cover.
Figure 6:
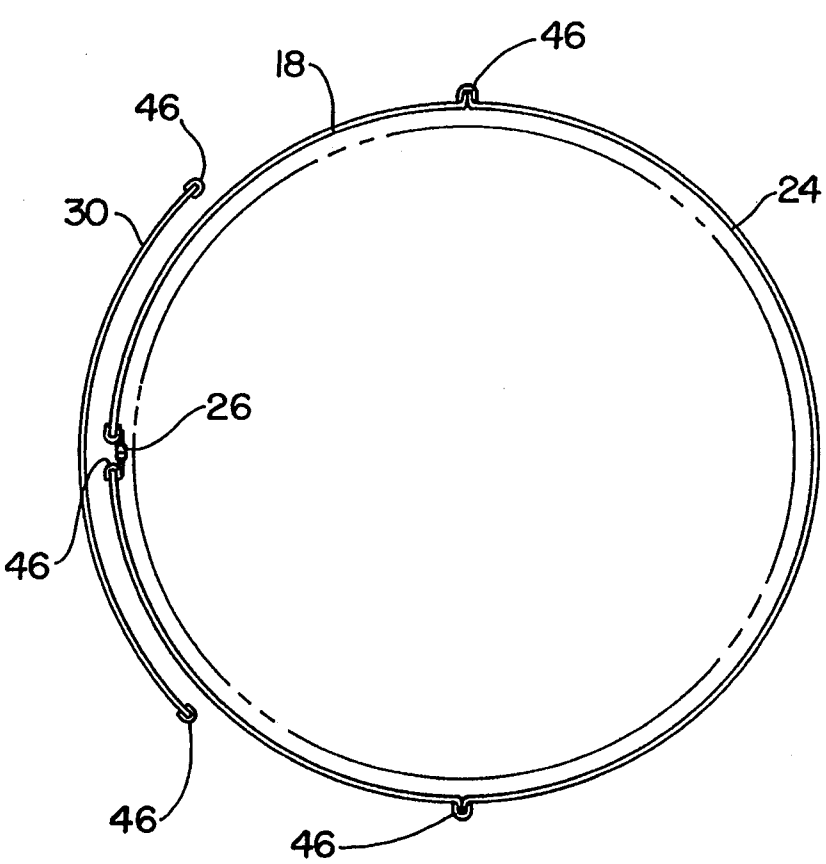
FIG. 6 is a cross section taken through lines 6—6 of FIG. 5.

With initial reference to FIG. 1, a cover 10 is shown placed over the top of a golf bag 12 as the bag typically is carried on a golf cart 14. The bag 12 is held on cart 14 by a strap around the upper portion of the bag, which strap is under the cover 10 and therefore not visible in the drawings. The cover 10 fits over the open, upper end of the golf bag covering not only that end, but also golf clubs and other implements which project from that end of the bag. Thus, the cover protects the open end of the bag and its contents from rain or dust. The cover also extends downward over the rear portion of the bag as mounted on the golf cart to also protect that portion of the bag and the openings to pockets located in that portion.

With reference to FIGS. 1–6, the upper portion of the cover 10 is formed by a dome-shaped hood 16 having front and rear panels 18 and 24 sewn together. The front panel 18 is made out of transparent material, such as a clear vinyl. The front panel has a curved upper edge 20 extending between ends of two straight side edges 21 and 22 with a fourth edge 23 extending between the other ends of each side edge 21 and 22. The rear panel 24 is made of a sheet of material similar in size to that of the front panel and has three edges aligned with and sewn to edges 20, 21 and 22 of the front panel. The combination of the two panels 18 and 24 open and spread apart to form a dome-like appearance to the hood 18 with a circular opening formed by the lower edges 23 and 25 of the panels. The cross section of this opening is sized to be able to be slid over the open end of the golf bag and downward to fit snugly around the upper portion of the bag 12.

The front panel 18 has a slit extending from the curved edge 20 straight to the lower edge 23 and a conventional zipper 26 is sewn in the slit to act as a closure. Tabs 27 and 29 are provided at the ends of the slit for the golfer to grasp when operating the zipper. The combination of the slit in the front panel 18 and the zipper 26 form a closable second opening in the hood 16. When the cover 10 is placed on the golf bag, a golfer is able to remove and insert golf clubs from and into the golf bag through the second opening formed when the zipper is open. Preferably, the zipper is formed of a plastic material to withstand moisture.

A generally rectangular flap 30 has one short edge sewn into the seam between the upper edges 20 of the front and rear panels 18 and 24. The flap 30 extends downward over the front panel 18 covering the zipper 26 and tabs 27 and 29 so that the golfer does not have to grasp a wet part of the cover in order to operate the zipper. A flap extends downward past the lower edge 23 of the front panel 18 to completely cover the zipper 26, thereby protecting it from rain which might penetrate through the seams of the zipper elements. Preferably, the flap 30 is formed of the same type of transparent material as the front panel so that the golfer is able to see through the hood and into the bag 12.

The cover 10 also includes an apron 32 having a width equal to the length of the lower edge 23 of the front panel 18. One edge 34 extending across the width of the apron 32 is sewn to the lower edge 23 of the front panel. The apron 32 extends downward from the front panel 18 covering the lower portion of the golf bag, when the cover 10 is placed onto the bag as shown in FIG. 1. The apron protects that lower portion of the bag and any external opening compartments of the bag from exposure to the environmental elements.

The apron 32 has two side edges 38 and 36 extending downward. Sewn to each of the side edges 36 and 38 of the apron 32 is a wing flap 40 and 42, respectively. Each wing flap 40 and 42 has a right-triangular shape with a longer edge 43 of the triangle sewn along the side flap 36 or 38 of the apron. This longer edge 43 of the wing flap 40 or 42 extends for substantially the entire length of edge 38. The shorter side 44 of the triangular wing flap 40 and 42 is sewn to the lower edge 25 of the rear panel 24. The hypotenuse of the triangular wing flaps 40 and 42 form an exposed edge. When the cover 10 is placed over the golf bag, the wing flaps 40 and 42 extend partially around the bag, as shown in FIG. 1 to hold the apron 32 against the bag preventing wind from causing the apron to move away from the bag 12.

The seams and edges of the front and rear panel 18 and 24 which form the hood 16 and the edges of the flap 30 are trimmed with seam-binding strips 46 to add strength to the seams and edges and resist tearing. The edges of apron 32 and wing flaps 40 and 42 are hemmed. The various components of the cover 10 are sewn together with zig-zag stitches for strength and to resist tearing on the seams.

The design of the cover permits the golfer to have easy access to the clubs through the zipper 26 because of the see-through front panel 18. The front flap 30 protects the zipper from leakage during heavy rain and can easily be folded back over the rear panel 24 in order to access the clubs through the zippered second opening in the hood 16.

Because the apron does not fully wrap around the lower section of the bag when held on a cart as shown in FIG. 1, the cover can be easily slipped over the bag without removal from the cart in the event of a sudden rainstorm occurring during a round of golf.

The rear panel 24, apron 32 and wing flaps 40 and 42 are typically made of an opaque flexible vinyl, although transparent vinyl and other water resistant fabric type materials may be used.

Figure 7:
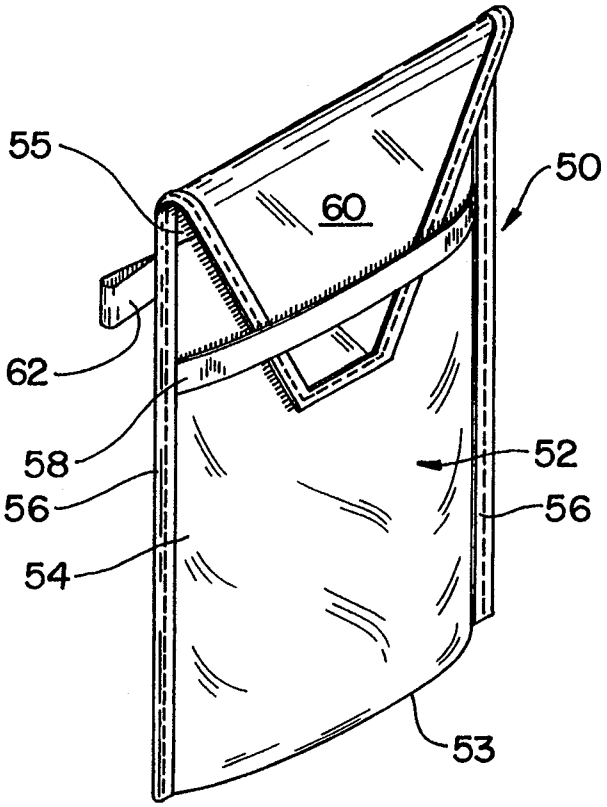
FIG. 7 is an isometric view of a case for the golf bag cover.

With reference to FIG. 7, when the cover 10 is not in use over a golf bag, it may be folded and stored in a carrying case 50. Preferably, the carrying case is fabricated of a single sheet 52 of a water resistant material, such as a clear vinyl. The sheet is folded along a lower edge 53 to provide a front flap 54 extending partially over a rear flap 55. The front and rear flaps 54 and 55 are sewn together at their seams with a binding tape 56. A fastening strap 58 extends across the front flap 54 and is sewn into the seams on either side of the flap. A tapered covering flap extends from a continuation of the rear flap 55 and can be bent downward over the front flap 54 and under the fastening strap 58 to secure the opening at the top of the case 50 through which the cover is inserted and removed.

A loop 62 is sewn into the seam between the front and rear flaps 54 and 55 and serves as a loop for attaching the case to a hook on a golf cart or golf bag.

We claim:

1. A cover for a golf bag which has an open end from which golf clubs project, said cover comprising:

a hood having a first opening for receiving the open end of the golf bag to protect the golf clubs retained in the golf bag, a second opening through which the golf clubs can be removed from the bag, and a mechanism for closing the second opening; and a flexible apron attached to said hood and extending from the first opening of the hood to protect a portion of the golf bag which projects from said hood, wherein said apron comprises a sheet having a first edge attached to said hood; a first wing flap along a second edge of said sheet; and a second wing flap along a third edge of said sheet; wherein first and second wing flaps extend around the golf bag to hold said apron in place.

2. A cover for a golf bag which has an open end from which golf clubs project, said cover comprising:

a hood having a first opening for receiving the open end of the golf bag to protect the golf clubs retained in the golf bag, and a second opening on a front side of the hood through which the golf clubs can be removed from the bag;

a flexible apron attached to said hood and extending from the opening of the hood to protect a portion of the golf bag which projects from said hood; and a flap fixedly attached to a top portion of said hood directly above said second opening on the front side of the hood and extending over the second opening.

3. The cover as recited in claim 2 wherein said hood further comprises a mechanism for closing the second opening.

4. The cover as recited in claim 2 wherein said second opening is an elongated slot extending vertically from said top portion toward said first opening.

5. The cover as recited in claim 4 further comprising a zipper for closing the second opening and tabs, located proximate to ends of the second opening, for a user to grasp while operating said zipper.

6. A cover for a golf bag which has an open end from which golf clubs project, said cover comprising:

a hood having a first opening for receiving the open end of the golf bag to protect the golf clubs retained in the golf bag, and a second opening through which the golf clubs can be removed from the bag;

a flexible apron attached to said hood and extending from the opening of the hood to protect a portion of the golf bag which projects from said hood; and a flap fixedly attached to a top portion of said hood and extending over the second opening wherein said apron comprises a sheet having a first edge attached to said hood; a first wing flap attached along an edge of said sheet and attached to said hood; and a second wing flap attached along an edge of said sheet and attached to said hood.

7. A system for storing and presenting golf clubs for play in inclement weather, said system comprising:

a golf bag, said golf bag having an open end from which golf clubs can project; and a cover, said cover including:

a hood having a first opening for receiving the open end of the golf bag to protect the golf clubs retained in the golf bag, a second opening through which the golf clubs can be removed from the bag, and a mechanism for closing the second opening; and a flexible apron attached to said hood and extending from the opening of the hood to a base end of said apron to protect a portion of the golf bag which projects from said hood, said apron extending substantially the length of said golf bag, said base end of said apron extending around no more than half the perimeter of said golf bag.

8. The cover as recited in claim 7 wherein said hood is at least partially formed of transparent material.

9. The cover as recited in claim 7 wherein said hood is formed by two panels each having four edges and three edges of each panel being attached together, wherein the second opening is formed in one of said panels.

10. The cover as recited in claim 9 wherein the one of said panels is fabricated of transparent material.

* * * * *